United States Patent [19]

Fuller

[11] 4,281,743

[45] Aug. 4, 1981

[54] INSULATING ENCLOSURE FOR DISAPPEARING STAIRWAY

[76] Inventor: George C. Fuller, 905 Brookfield Pkwy., Roswell, Ga. 30075

[21] Appl. No.: 97,035

[22] Filed: Nov. 23, 1979

[51] Int. Cl.[3] ..... E06C 9/08

[52] U.S. Cl. ..... 182/46; 182/78; 182/129

[58] Field of Search ..... 182/46, 47, 77-81

[56] References Cited

U.S. PATENT DOCUMENTS

| | | | |
|---|---|---|---|
| 2,191,774 | 2/1940 | Reed | 98/43 |
| 2,439,602 | 4/1948 | Heritage | 20/101 |
| 2,464,000 | 3/1949 | Schild | 98/43 |
| 2,496,773 | 2/1950 | Brown | 182/81 |
| 4,151,894 | 5/1979 | Edwards | 182/46 |

FOREIGN PATENT DOCUMENTS

| | | | |
|---|---|---|---|
| 204152 | 7/1959 | Austria | 182/47 |
| 468575 | 10/1950 | Canada | 182/81 |

*Primary Examiner*—Reinaldo P. Machado
*Attorney, Agent, or Firm*—Jones, Thomas & Askew

[57] ABSTRACT

A relatively lightweight insulating enclosure for placement over an attic structure such as a disappearing stairway or an attic fan, to reduce unwanted heat transfer through the structure when closed. The insulating enclosure comprises a number of box segments made of a lightweight insulating material such as foamed polystyrene, connected together with overlapping joints. Expansion members are optionally included to enlarge the width of the assembled enclosure.

10 Claims, 6 Drawing Figures

INSULATING ENCLOSURE FOR DISAPPEARING STAIRWAY

BACKGROUND OF INVENTION

This invention relates in general to disappearing stairways, and in particular to apparatus for insulating such stairways against unwanted heat transfer when the stairway is closed.

Disappearing stairways are widely used for residential and other applications where there is a need for a stairway extending upwardly to a seldom-used area such as an attic or the like. Typical examples of disappearing stairways are shown in U.S. Pat. Nos. 2,649,237 and 2,852,176; such stairways normally fold and retract upwardly into a frame that is secured between adjacent joists of the attic, and the folded stairway is covered by a door which normally extends substantially flush with the finished ceiling of the room in which the stairway is mounted. Disappearing stairways thus take up no floor space except when actually extended, and are also inexpensive to construct as compared with fixed stairways that are typically constructed on-site, and so disappearing stairways are generally preferred for access to attics or other seldom-used areas.

Although the typical disappearing stairway is enclosed from below by a door or cover panel when folded and not in use, there may nevertheless be a substantial amount of unwanted heat transfer through the ceiling where the disappearing stairway is located. As may be seen from the foregoing patents as well as other examples of disappearing stairway construction, the folded disappearing stairway fits between joists in a space lacking the insulation that would otherwise be present in a well-constructed building. The door or cover panel forming part of the disappearing stairway is typically a relatively thin sheet of material such as plywood or the like, affording relatively poor resistance to heat flow. Moreover, the door or cover panel may fit imperfectly within the frame of the disappearing stairway, particularly where the door may have warped somewhat due to aging. The heat loss or heat gain through a closed disappearing stairway may affect the amount of energy required to adequately heat or cool a building, and can alternatively affect the uniformity of heating or cooling due to localized temperature variations in the vicinity of the stairway. The heating/cooling control thermostat is frequently located in a hallway beneath or near the disappearing stairway, and is subject to unwanted operation by air leaking out of the attic.

The nature and construction of typical disappearing stairways makes it difficult to insulate such stairways merely by adding conventional insulation. The existing door or cover to the stairway usually has a portion of the stairway folding ladder affixed to the interior of the door, and another portion of the stairway typically lies over the first portion when folded, so that typical attic insulation such as batts or loose insulation cannot practicably be applied to the inside of the stairway door. Insulation material added to the underside of the stairway door would project downwardly from the ceiling and thus would be unsightly when the stairway was folded and would still not overcome heat transfer due to drafts through a poorly fitting closed door. Insulating expedients such as proposed above would, moreover, be difficult to apply by people lacking carpentry skills.

Other types of attic structures, such as attic fans, have ceiling openings which may leak air when not in use. Although attic fans may have a self-closing door, the doors are usually relatively thin and uninsulated.

SUMMARY OF INVENTION

Stated in general terms, the present invention comprises a lightweight insulated box configured to fit on the folded stairway from above, and defining an enclosed volume immediately above the stairway, so as to substantially reduce heat transfer through the closed stairway. The box is relatively lightweight so that it can readily and easily be temporarily displaced by a person climbing the stairway, and then easily replaced to cover the stairway as the person descends the steps prior to reclosing the stairway. Stated somewhat more particularly, the insulating enclosure of the present invention comprises a number of box segments that fit together to define an insulating box of sufficient dimension to enclose the folded stairway. The box segments are configured to nest together when disassembled, so that the box occupies minimum space for shipment and storage. Adjacent edges of the box segments fit together with overlapping joints so as to lend structural integrity and reduce heat transfer through the joints. The segmented box may be provided with expansion members which optionally fit between box segments to enlarge a dimension of the box, so that one basic box design can be made and sold to fit a variety of existing disappearing stairways.

DESCRIPTION OF PREFERRED EMBODIMENT

Figure 1:
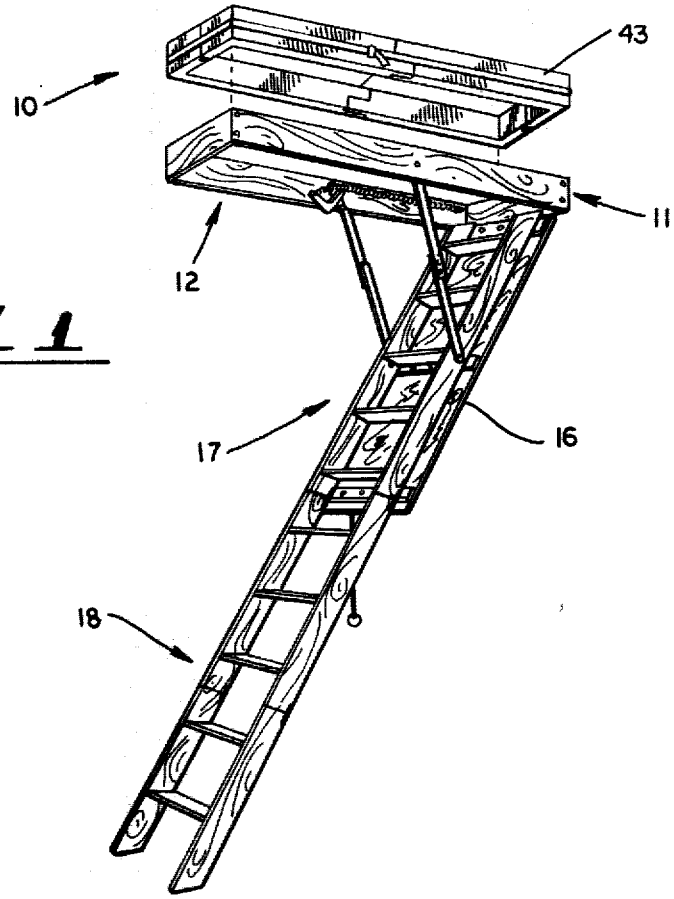
FIG. 1 is a pictorial view showing a typical disappearing stairway of the prior art, equipped with an insulating enclosure according to one disclosed embodiment of the present invention. The insulating disclosure is shown elevated above the disappearing stairway, for illustrative purposes.

Turning to FIG. 1, there is shown generally at 10 an insulating enclosure according to a preferred embodiment of the present invention, shown in elevated position over a typical disappearing stairway 11 shown in extended position. Specific details of the particular disappearing stairway 11 are not critical to the present invention, and those details are here set forth only to the limited extent necessary to explain the construction and operation of the insulating enclosure 10.

Figure 5:
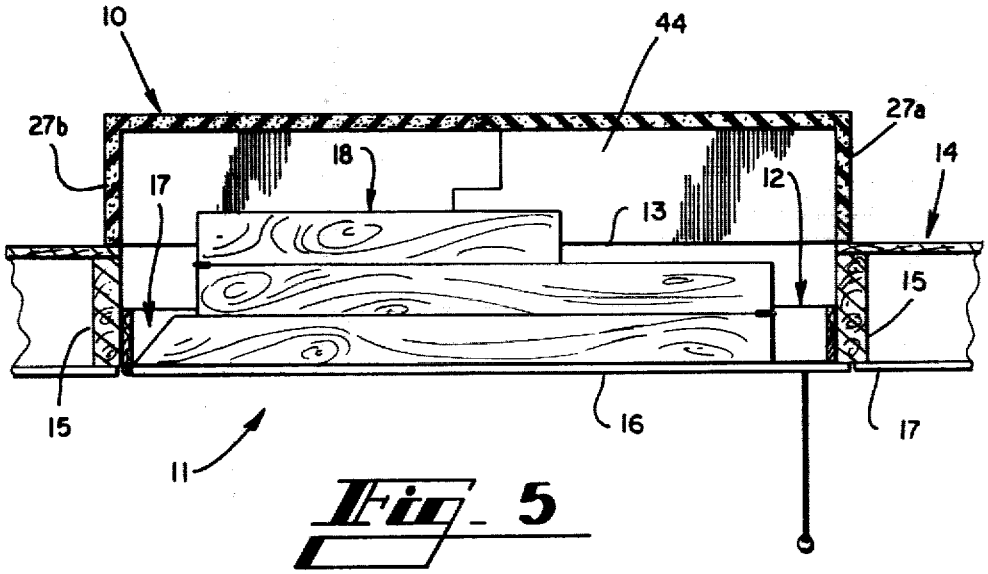
FIG. 5 shows a horizontal sectioned view of the structure shown in FIG. 1, with the disappearing stairway folded and with the insulating enclosure in normal position thereover.

Looking at FIG. 1 together with FIG. 5 to understand more fully the environment of the present invention, the disappearing stairway 11 includes an outside frame 12 which is mounted between adjacent floor joists 13 of the attic floor 14. Cross braces 15 are mounted between a pair of adjacent floor joists 13 to provide end support for the frame 12 of the disappearing stairway. Those skilled in the art will understand that the stairway 11 is mounted in the ceiling by securing the frame 12 to the joists 13 and the cross braces 15. A door or cover panel 16 forms part of the disappearing stairway 11 and is hinged to the outer frame 12, so that the door becomes substantially flush with the ceiling 17 (FIG. 2) when the disappearing stairway is folded. The disappearing stairway also includes a first stair or ladder portion 17 affixed to the inner face of the door 16, and a second stair portion 18 hinged to the first stair portion so as to be unfolded or folded when the disappearing stairway is opened or closed. It will be understood that the second stair portion 18 in practice may consist of two separate hinged stair segments, so that the stairway can fold onto itself in a relatively compact fashion as illustrated in FIG. 2.

Figure 2:
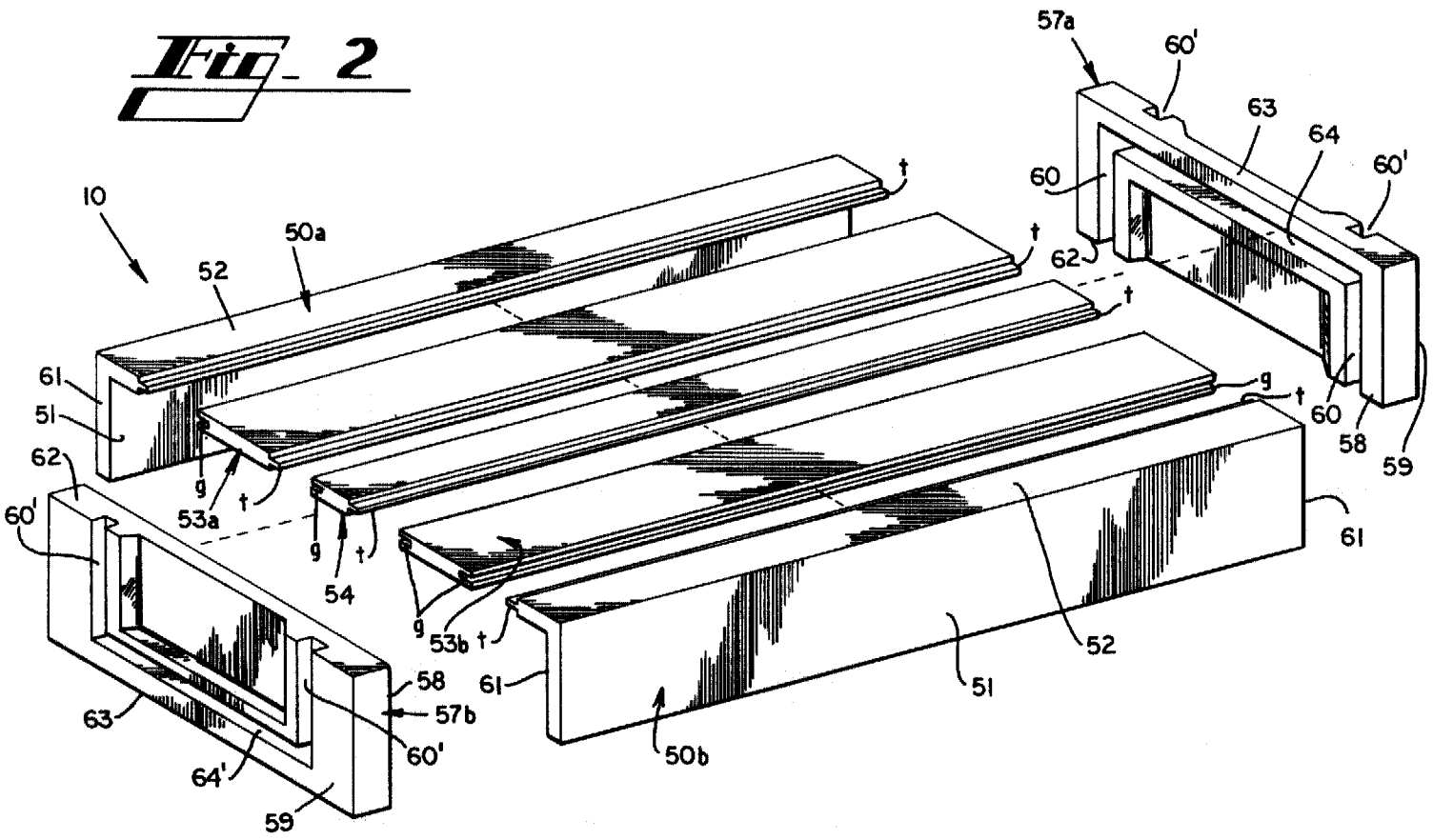
FIG. 2 is an exploded view of an insulating enclosure according to another disclosed embodiment of the present invention.

The preferred embodiment of insulating enclosure 10 according to the present invention is shown in exploded view in FIG. 2. The enclosure 10 includes a pair of side members 50*a* and 50*b*, each of which has a side wall 51 and a top wall 52 terminating in a longitudinal edge in which is formed a protruding tongue t. Each of the side members 50*a* and 50*b* are preferably identical in size and configuration, so that the two side members required for an insulating member 10 can be manufactured with but a single set of tooling.

Interposed between the tongues t of the two side members 50*a* and 50*b* are the top panels 53*a* and 53*b*, each of which is preferably identical to the other except for the tongue and groove connections along the longitudinal edges. The top panels 53*a* and 53*b* in the disclosed embodiment constitutes flat rectangular panels having a pair of longitudinal edges, with a recess groove g formed within the length of one such edge and with a protruding tongue t extending upwardly from the other such edge in the top panel 53*a*. The top panel 53*b* has a groove g along each of its longitudinal edges. It should be apparent that the grooves g in each of the top panels 53*a* and 53*b* are configured to meet with the tongue t formed in the respective confronting top surface of each side members, as more fully described below.

Positioned between the two top panels 53*a* and 53*b* is the expansion panel 54, in the shape of a rectangular member having the same length as the top panels but preferably of somewhat reduced width. The longitudinal sides of the expansion panel 54 are respectively equipped with a groove g and a tongue t which mate with the confronting tongue and groove formed in the top panels 53*a* and 53*b*, respectively.

While commercially available disappearing stairways typically come in a number of sizes, most disappearing stairways presently on the market have substantially have the same length and are available in several standard widths. The width or lateral dimensions of each top wall 52 of the side members 50*a* and 50*b*, combined with the width of each top panel 53*a* and 53*b*, is preferably selected so that an insulating enclosure 10 assemblied without the expansion panel 54 is sufficiently wide to enclose disappearing stairways of smaller standard width. The width of the expansion panel 54, when assembled between the top panels 53*a* and 53*b* as shown in FIG. 2, is selected to provide an insulating enclosure wide enough to cover the larger size of commercially available disappearing stairways. Although the expansion panel 54 may be marketed separately from the remaining elements of the insulating enclosure shown in FIG. 2, it is probable that the expansion panel and other elements of the insulating enclosure will be sold as a complete knocked-down insulating enclosure kit that the purchaser can quickly assembly (with or without the expansion panel as needed) to fit nearly any disappearing stairway present in use.

The side members 50*a* and 50*b*, the top panels 53*a* and 53*b*, and the expansion panel 54 if used, are joined together by the two end members 57*a* and 57*b* shown in FIG. 2. The end members 57*a* and 57*b* are preferrably identical in configuration. For that reason, each end member has a first side 58 configured to engage and hold together the assembled side members and top panels including the expansion panel 54, and a second side 59 configured to hold together the foregoing assembly when the expansion panel is omitted from assembly.

Each side 58 and 59 of the end members 57*a* and 57*b* has a pair of laterally-extending slots 60, with the slots on the second side 59 being indicated 60'; the lateral slots 60 and 60' are each of sufficient length and width to snugly accommodate the lateral width 61 of the side member 50*a* and 50*b*. The lateral slots 60 on the first side 58 extend from one longitudinal side 62 of the end member to terminate at inner ends spaced inwardly from the other longitudinal side 63 of the end member. Extending between the inner end of each slot 60 is a longitudinal slot 64 sufficiently long to accommodate the combined widths of the side member top walls 52, the top panels 53*a* and 53*b*, and the expansion panel 54 when assembled.

The second side 59 of each end member 57*a* and 57*b* is provided with corresponding lateral slots 60', as best illustrated with the end member 57*b* in FIG. 2, and the inner ends of the lateral slots 61 are interconnected by a longitudinal slot 64'. The length of the longitudinal slot 64' is sufficient to accommodate the combined widths of the foregoing assembled members, excluding the expansion panel 54.

It should now be apparent that a single pair of end members 57*a* and 57*b* is equally useful in assembling an insulated enclosure 10 either of larger width including the expansion panel 54 or of smaller widths without that expansion panel, simply by selecting the first sides 58 or second sides 59 of the end members for interconnecting with the other members making up the insulating enclosure. The longitudinal slots 64 and 64' on each end member 57*a* and 57*b* are preferrably located adjacent the opposite longitudinal sides 63 and 62, respectively, so as to avoid weakening the end members; the area within the slots on either or both sides of each end member may be scalloped as shown so as to reduce the volume of material in the end members. Each of the side members, top panels, and the expansion panel is preferrably fabricated from a relatively light weight material such as polystyrene foam or the like, having good thermal insulating qualities. An enclosure 10 made of a material such as foamed polymer or the like is especially preferred, because of the resulting assembled enclosure has excellent insulating qualities yet is sufficiently lightweight to be readily lifted and displaced by a person climbing the lowered stairway, so that access to the attic may be gained by lifting upwardly on the top portion of the enclosure without struggling with a relatively heavy object. The tongue and groove construction and the snugly fitting end members prevent air leaks through the insulated enclosure. Those skilled in the art will understand that other suitable insulating materials may be used in constructing the insulating enclosure according to the present invention.

Figure 3:
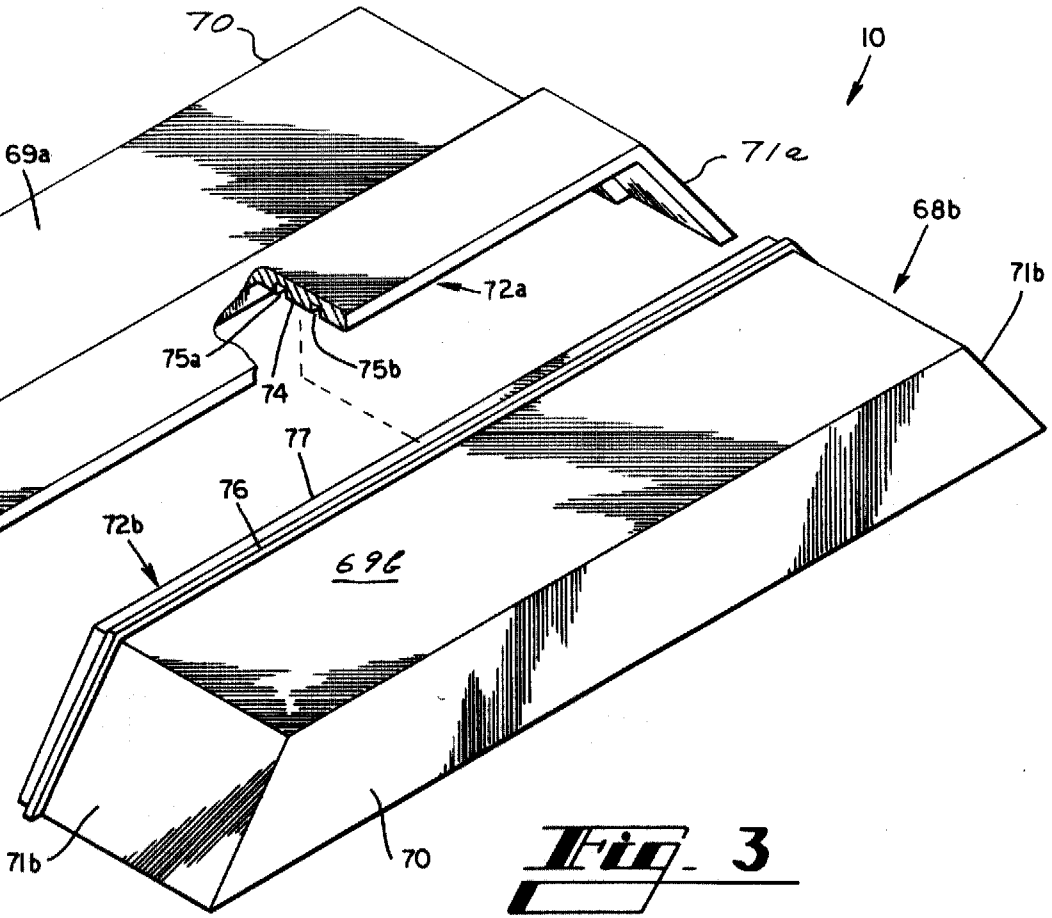
FIG. 3 is an exploded view of still another embodiment of the present invention, shown partially broken away for illustrative purposes.
Figure 4:
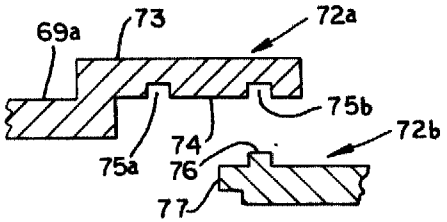
FIG. 4 is a sectioned partial view of the embodiment shown in FIG. 3, illustrating the variable width connecting features of that embodiment.

FIGS. 3 and 4 show another disclosed embodiment of the present invention, in which an insulating enclosure 10 of adjustable width is provided with but two separate members, namely, a first side member 68*a* and a second member 68*b*. Each of the side members include a top wall panel 69*a* and 69*b*, a side wall 70, and a pair of end panels 71*a*, 71*b* joined to the side walls and to the top wall panels at an obtuse angle. The side members 68*a* and 68*b* are preferably unitary, and may be fabricated either by molding as a unitary article or by other suitable fabricating techniques.

Extending longitudinally along each side member 68*a* and 68*b*, and including the following dimensions of the end panels 71*a* and 71*b* as well as the length of the top wall panels 69*a* and 69*b*, are the overlapping connecting joints, respectively designated 72*a* and 72*b*. The connecting joint 72*a*, as particularly seen in FIG. 4, includes a panel portion 73 integral with the top wall panel 69*a* and joined to that panel by a joggle so that the undersurface 74 of the panel portion is approximately coplanar with the exterior surface of the top wall panel. A pair of longitudinally extending slots 75*a* and 75*b* are formed in the undersurface of 74 of the panel portion 73, and extend along the full length of that panel portion.

The connecting joint 72*b*, as also best seen in FIG. 4, primarily comprises a tongue member 76 raised upwardly from the top wall panel 69*b*, and spaced laterally inwardly a short distance from the outer edge 77 of that panel. The width and depth of the tongue 76 is selected to provide a snug complementary fit within either or the slots 75*a*, 75*b* formed in the connecting joint 72*a*.

It should now be apparent that the two side members 68*a* and 68*b* are joined together simply by interconnecting the tongue 76 with either of the slots 75*a* or 75*b*, depending on whether an overall insulating enclosure 10 of lesser or greater width is desired. The interconnected joints 72*a* and 72*b* may be pinned together by simply pressing several small nails through the overlapping portions of the connecting joints, although the natural friction-fit of the connecting joints may provide sufficient interconnective force in many applications. The insulating enclosure embodiment shown in FIGS. 3 and 4 thus requires but two separate parts to manufacture, store, and ship, although those two parts are somewhat bulky and less convenient to package than are the several flat elements making up the embodiment described in FIG. 2.

Figure 6:
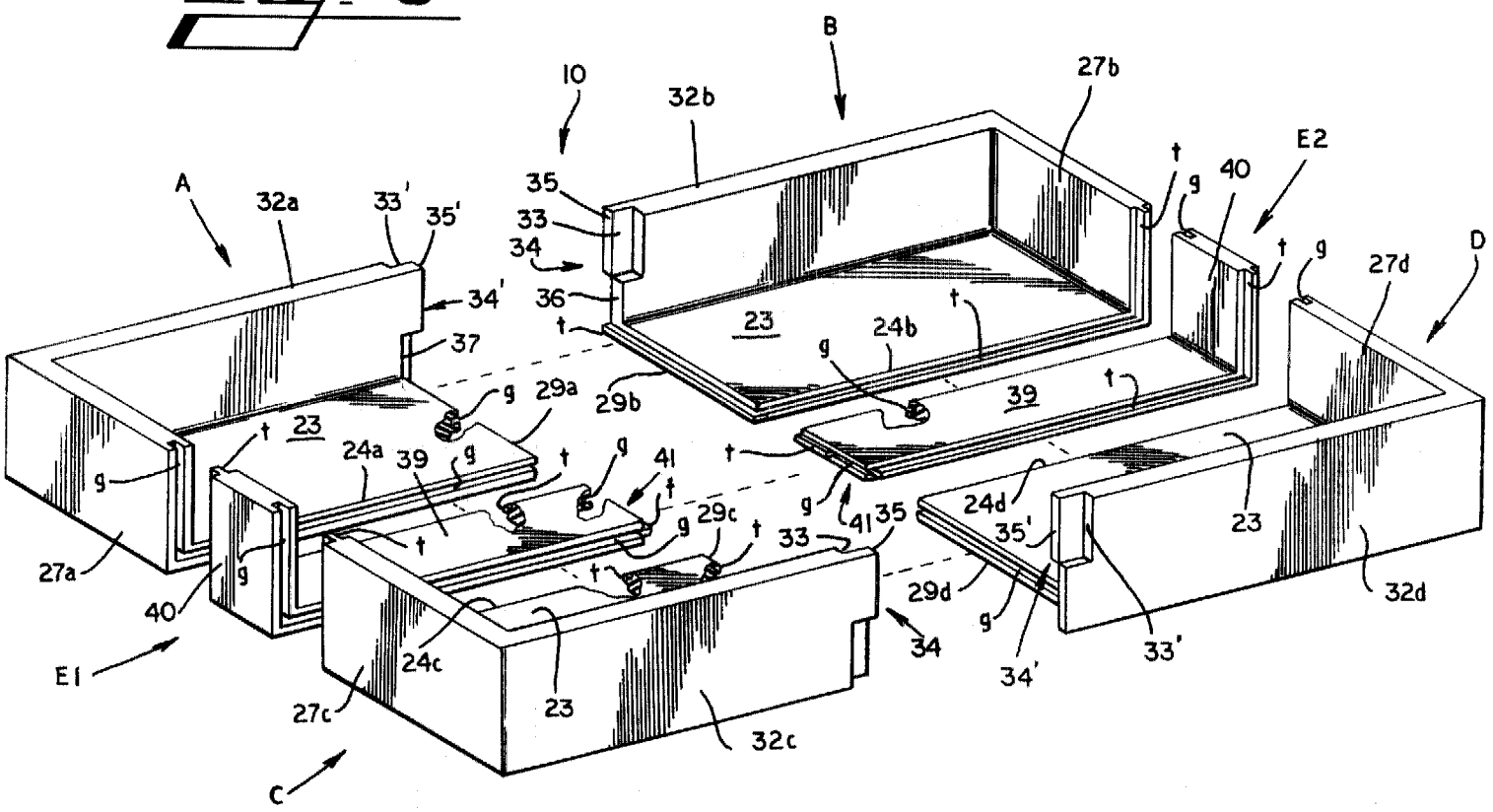
FIG. 6 is an exploded view of the disclosed insulating enclosure embodiment disclosed in FIGS. 1 and 5.

The embodiment of insulating enclosure 10 shown in FIG. 1 is seen explained in detail with reference to the exploded view of FIG. 6; that enclosure is assembled from four box segments A, B, C, and D; and from a pair of expansion members E1 and E2. Each of the box segments A–D comprises a quarter of the overall insulated enclosure 10 as shown in assembly in FIG. 1, it being understood that the assembled enclosure 10 in FIG. 1 omits the expansion members E1 and E2 for illustrative purposes. The width of each box segment A–D is preferably selected so that an insulating enclosure 10 assembled without the expansion members E1 and E2 is sufficiently wide to enclose disappearing stairways of smaller standard width; the width of the expansion members, when assembled between the box segments A, B and C, D as shown in FIG. 6, provides an insulating enclosure wide enough to cover the larger size disappearing stairway. Although the expansion members E1 and E2 (which are structurally identical as will be shown) may be marketed separately from the box segments A–D, it will be understood that the four box segments and two expansion members can be sold as a complete knocked-down insulating enclosure kit that can be quickly user-assembled to fit nearly any disappearing stairway presently in use.

Each of the box segments and expansion members is interconnected with overlapping joints which reduce heat transfer therethrough, and which also contribute to the structural integrity of the assembled enclosure. Turning again to FIG. 6, it is seen that the box segment A has a groove g formed within the longitudinal side 24*a*, and the box segment C has a complementary tongue t extending outwardly along the longitudinal edge 24*c*. Similarly, the box segment B has a tongue t extending outwardly from the longitudinal side 24*b*, and the box segment D has a complementary groove g formed in its longitudinal side 24*d*. The respective tongues and grooves extend the entire length of the longitudinal sides, and continue along the confronting edges of the end walls 27*a*–27*d* of the four box segments.

The lateral edges 29*a*–29*d* of the respective box segments A–D are also equipped with mating tongues t and grooves g as shown; sides 29*a* and 29*b* are respectively equipped with a groove and tongue connection, while sides 29*c* and 29*d* are respectively equipped with a tongue t and groove g.

The joints extending upwardly along the side walls 32*a*, 32*b*, 32*c* and 32*d* of the box segments are alternating overlapping joints instead of tongue-and-groove joints. The alternating overlap on each of the side wall joints is provided by a recess 33 formed in the inside of the side wall 32*b* and extending a short distance back from the side edge 34 to define the outer flange 35, along approximately the upper half of that side edge; and by a complementary recess 33′ formed in the opposite side edge 34′ to define a flange 35′, along approximately the upper half of side edge 34′, to fit snugly within the recess 33 inside edge 34. The lower half of the side edges 34 and 34′ alternately have a mating recess 36 and flange 37 to complete the alternating overlap joint. The side walls 32*c* and 32*d* are equipped with a similar alternating overlap joint.

Each of the expansion members E1 and E2 is essentially an elongated L-shaped member having a top portion 39 fitting between the top portions 23 of adjacent box segments A, C, or B, D, and having an end wall 40 to fit between the end walls 27*a*, 27*c* or 27*b*, 27*d*, respectively, of the corresponding box segments. The longitudinal sides of each expansion member E1 and E2 have tongues t and grooves g complementary to the longitudinal sides of the confronting box segments. The lateral ends 41 of each expansion member E1 and E2 have a tongue t along half the extent of the end, followed by a groove g along the remaining half. It is thus seen that the tongue and groove on the end 41 of each expansion member effectively comprise an extension of the tongue and groove in the lateral edges 29 (such as edges 29*b* and 29*d*) of the box segments between which the expansion member fits, thereby simplifying tongue-groove alignment problems when the enclosure 10 is assembled with the expansion members in place.

It is also apparent that the expansion members E1 and E2 are structurally identical, thereby providing a savings in manufacturing costs. Moreover, it is seen that the box segments B and C are identical to each other, and that the box segments A and D are identical to each other. Thus, a complete insulating enclosure according to the present invention may be manufactured and offered for sale, including the four box segments and two expansion members, out of three basic manufactured components.

The construction and design of the individual components permits the insulated enclosure 10 to be assembled and shipped in knocked-down condition, with the box segments and expansion members (if included) nested together to occupy a relatively compact volume. These components are easily assembled by the end-user purchaser, and the tongue-groove construction along with the lap joints provides a relatively snug airtight fit for the assembled enclosure. Although the lap joints and tongue-grooved joints may be adequate to hold together the assembled enclosure it may also be desirable to provide a relatively lightweight binder such as the encircling strap 43 (FIG. 1) wrapped about the assembled enclosure, so that the enclosure does not inadvertently come apart when maneuvered in place about the disappearing stairway. The strap 43 can be a relatively lightweight strap made of a suitable material such as plastic or the like, fitted with a friction buckle, inasmuch as the strap will undergo only a relatively small tension load in use. It should also be apparent that a similar strap can be used to hold in assembly the embodiment of FIG. 2, if necessary.

The use of the present insulating enclosure should now be apparent, and will be further explained with reference to FIGS. 1 and 5. The enclosure 10 is assembled from the components, with or without the expansion member(s) or expansion connection as needed to fit a particular disappearing stairway. The stairway is then temporarily opened, and the assembled enclosure 10 weighing at most a few pounds is easily carried up the stairway. The enclosure 10 is then positioned on top of the joists 13 and bracing 15 immediately above the disappearing stairway, either on the attic floor if present or otherwise on the joists and bracing itself. The disappearing stairway is then folded to its normal retracted position as shown in FIG. 5, and the enclosure 10 defines a volume 44 which is substantially closed off from the remainder of the attic. Thus, the relatively thin stairway door 16 and any cracks or gaps between that door and the surrounding frame 12 are substantially isolated from heat transfer with the relatively hotter or colder interior of the attic.

An insulating enclosure constructed according to the foregoing can also be used as a removable enclosure for other attic structures such as attic fans, when not in use. It will be understood that the overall shape of the enclosure will preferably be changed to fit over and enclose the frame of the attic fan or other structure.

It should be understood that the foregoing relates only to a preferred embodiment of the present invention, and that numerous changes and modifications may be made therein without departing from the spirit and scope of the claims which follow.

I claim:

1. A knockdown enclosure for insulating a pull-down stairway of the type set in a ceiling, comprising:

a generally rectangular box having a closed top, an open bottom, and closed sides and ends and dimensions of length and width sufficient to fit over and enclose an air space over the pull-down stairway from above the ceiling;

said box comprising a number of box segments that fit together with overlapping joints so as to reduce heat transfer through the joints; and said box segments being made of material that is a good thermal insulator so as to minimize heat transfer through the box between the air space and the surrounding space above the ceiling.

2. An enclosure as in claim 1, wherein said box is further characterized by:

a pair of elongated side members, each of which includes a side wall comprising said closed sides of the box, and a top wall joined to said side wall and comprising a portion of said closed top;

at least one elongated top panel of substantially the same length as said side members and configured to fit between said top walls of said side members, so that said top panel and said top walls when joined together comprise said closed top of the box; and a pair of separate end members each of which is operative to engage and interconnect with said side member and said top panel to form said closed ends of the box.

3. An enclosure as in claim 2, wherein:

each of said end members includes a first side and a second side;

one of said sides having a pair of slots formed therein;

each of said slots being operative to snugly receive one end of said side wall;

said slots being mutually spaced apart on said one side of said end member by a first distance corresponding to the lateral dimension of said closed top of the box; and said slots being joined by a third slot formed in said one side of said end member;

said third slot in each of said end members being operative to snugly receive one end of each said top wall and one end of said top panel when joined together.

4. An enclosure as in claim 3, wherein:

the other side of each said end member also has a pair of slots formed therein to snugly receive the corresponding ends of said side walls;

said slots being mutually spaced apart by a second distance greater than said first distance; and said slot in said other side being joined by a third slot formed in said other side and operative to snugly receive ends of each said top wall and a plurality of said top panels when joined together.

5. An enclosure as in claim 1, wherein said box is further characterizedly:

a pair of elongated side members, each of which includes a side wall comprising said closed sides of the box, a top wall panel joined to said side wall and comprising a portion of said closed top of the box, and an end panel, joined to said side wall and said top wall panel and comprising a portion of said closed end of the box; and each of said side members having a mutually complementary connecting joint which extends along the longitudinal edge of the top wall panel laterally spaced apart from the side wall; and which extends along the corresponding edge of each end panel;

so that said side member are mutually attachable along said connecting joint to form an enclosure that is substantially airtight.

6. An enclosure as in claim 1, wherein:

said box is divided longitudinally and laterally along said closed top to comprise four box segments;

each said box segment mating in adjacent box segments along a longitudinal edge and a lateral edge; and each of said longitudinal edges and lateral edges defining a joint which overlaps a complementary joint on the adjacent box segment.

7. An enclosure as in claim 6, wherein:

each said longitudinal edge of two of said box segments comprises a longitudinal tongue, and the longitudinal edges of the two remaining box segments comprise longitudinal mating grooves; and each said lateral edge of two of said box segments comprises a tongue, and the lateral edges of the two remaining box segments comprise mating grooves.

8. An enclosure as in claim 7, wherein:

said longitudinal and lateral divisions of said box extend across said closed sides, so that each of the divided sides mates along a side joint when the box segments are assembled into said box;

each mating side joints comprises an alternating overlapping joint.

9. An enclosure as in claim 1, wherein:

said box is divided into said box segments along said closed top and said ends; and further comprising;

expansion means configured to fit between said longitudinal division in mating engagement with said box segments, so as to increase the width of said box;

said expansion means having longitudinally extending joints which matingly engage said overlapping joints of said longitudinal division, and being made of said thermally insulating material.

10. An enclosure as in claim 9, wherein:

said box is divided laterally as well as longitudinally so as to comprise four box segments;

said expansion means comprises a pair of expansion members each having a first plane wall fitting between and extending the divided top of two longitudinally divided box segments, and a second plane wall perpendicular to said first plane wall and fitting between and extending the divided end wall of said two box segments;

the longitudinal edges of said two box segments having mating tongue and groove construction permitting said box segments to be directly joined together; and the longitudinal edges of each expansion member having respectively tongue and groove construction to permit an expansion member to be selectably and matingly interposed between said two box segments.

* * * * *